US009319781B2

(12) United States Patent
Alderson et al.

(10) Patent No.: US 9,319,781 B2
(45) Date of Patent: Apr. 19, 2016

(54) FREQUENCY AND DIRECTION-DEPENDENT AMBIENT SOUND HANDLING IN PERSONAL AUDIO DEVICES HAVING ADAPTIVE NOISE CANCELLATION (ANC)

(71) Applicant: Cirrus Logic, Inc., Austin, TX (US)

(72) Inventors: Jeffrey Alderson, Austin, TX (US); Jon D. Hendrix, Wimberly, TX (US); Dayong Zhou, Austin, TX (US)

(73) Assignee: CIRRUS LOGIC, INC., Austin, TX (US)

( * ) Notice: Subject to any disclaimer, the term of this patent is extended or adjusted under 35 U.S.C. 154(b) by 198 days.

(21) Appl. No.: 13/784,018

(22) Filed: Mar. 4, 2013

(65) Prior Publication Data

US 2013/0301846 A1 Nov. 14, 2013

Related U.S. Application Data

(60) Provisional application No. 61/645,244, filed on May 10, 2012.

(51) Int. Cl.
*G10K 11/16* (2006.01)
*H04R 3/00* (2006.01)
(Continued)

(52) U.S. Cl.
CPC ..... *H04R 3/002* (2013.01); *G10K 11/1784* (2013.01); *G10K 11/1788* (2013.01);
(Continued)

(58) Field of Classification Search
CPC ..... G10K 11/1784; G10K 11/1788; G10K 2210/108; G10K 2210/3226; G10K 2210/30391; H04R 1/1083
USPC ..... 381/71.1, 71.2, 71.3, 71.4, 71.5, 71.6, 381/71.7, 71.8, 71.9, 71.11, 71.12, 71.13, 381/71.14
See application file for complete search history.

(56) References Cited

U.S. PATENT DOCUMENTS 4,020,567 A 5/1977 Webster
4,926,464 A 5/1990 Schley-May
(Continued)

FOREIGN PATENT DOCUMENTS

DE 102011013343 A1 9/2012
EP 0412902 A2 2/1991
(Continued)

OTHER PUBLICATIONS

Black, John W., "An Application of Side-Tone in Subjective Tests of Microphones and Headsets", Project Report No. NM 001 064.01.20, Research Report of the U.S. Naval School of Aviation Medicine, Feb. 1, 1954, 12 pages (pp. 1-12 in pdf), Pensacola, FL, US.
(Continued)

*Primary Examiner* — Paul S Kim
*Assistant Examiner* — Katherine Faley
(74) *Attorney, Agent, or Firm* — Mitch Harris, Atty at Law, LLC; Andrew M. Harris

(57) ABSTRACT

A personal audio device, such as a wireless telephone, includes noise canceling circuit that adaptively generates an anti-noise signal from a reference microphone signal and injects the anti-noise signal into the speaker or other transducer output to cause cancellation of ambient audio sounds. An error microphone may also be provided proximate the speaker to measure the output of the transducer in order to control the adaptation of the anti-noise signal and to estimate an electro-acoustical path from the noise canceling circuit through the transducer. A processing circuit that performs the adaptive noise canceling (ANC) function also detects frequency-dependent characteristics in and/or direction of the ambient sounds and alters adaptation of the noise canceling circuit in response to the detection.

45 Claims, 7 Drawing Sheets

(51) Int. Cl.
*G10K 11/178* (2006.01)
*H04R 1/10* (2006.01)

(52) U.S. Cl.
CPC ..... *H04R1/1083* (2013.01); *H04R 3/00* (2013.01); *G10K 2210/108* (2013.01); *G10K 2210/3012* (2013.01); *G10K 2210/3025* (2013.01); *G10K 2210/3028* (2013.01); *G10K 2210/30231* (2013.01); *G10K 2210/30391* (2013.01); *G10K 2210/3226* (2013.01); *G10K 2210/503* (2013.01)

(56) References Cited

U.S. PATENT DOCUMENTS 4,998,241 A 3/1991 Brox et al.
5,018,202 A 5/1991 Takahashi
5,021,753 A 6/1991 Chapman
5,044,373 A 9/1991 Northeved et al.
5,117,401 A 5/1992 Feintuch
5,251,263 A 10/1993 Andrea et al.
5,278,913 A 1/1994 Delfosse et al.
5,321,759 A 6/1994 Yuan
5,337,365 A 8/1994 Hamabe et al.
5,359,662 A 10/1994 Yuan et al.
5,377,276 A 12/1994 Terai et al.
5,386,477 A 1/1995 Popovich et al.
5,410,605 A 4/1995 Sawada et al.
5,425,105 A 6/1995 Lo et al.
5,445,517 A 8/1995 Kondou et al.
5,465,413 A 11/1995 Enge et al.
5,481,615 A 1/1996 Eatwell et al.
5,548,681 A 8/1996 Gleaves et al.
5,550,925 A 8/1996 Hori et al.
5,559,893 A 9/1996 Krokstad et al.
5,586,190 A 12/1996 Trantow et al.
5,640,450 A 6/1997 Watanabe
5,668,747 A 9/1997 Ohashi
5,687,075 A 11/1997 Stothers
5,696,831 A 12/1997 Inanaga et al.
5,699,437 A 12/1997 Finn
5,706,344 A 1/1998 Finn
5,740,256 A 4/1998 Castello Da Costa et al.
5,768,124 A 6/1998 Stothers et al.
5,815,582 A 9/1998 Claybaugh et al.
5,832,095 A 11/1998 Daniels
5,852,667 A 12/1998 Pan et al.
5,909,498 A 6/1999 Smith
5,940,519 A 8/1999 Kuo
5,946,391 A 8/1999 Dragwidge et al.
5,991,418 A 11/1999 Kuo
6,041,126 A 3/2000 Terai et al.
6,118,878 A 9/2000 Jones
6,181,801 B1 1/2001 Puthuff et al.
6,219,427 B1 4/2001 Kates et al.
6,278,786 B1 8/2001 McIntosh
6,282,176 B1 8/2001 Hemkumar
6,304,179 B1 10/2001 Lotito et al.
6,317,501 B1 11/2001 Matsuo
6,418,228 B1 7/2002 Terai et al.
6,434,246 B1 8/2002 Kates et al.
6,434,247 B1 8/2002 Kates et al.
6,445,799 B1 9/2002 Taenzer et al.
6,522,746 B1 2/2003 Marchok et al.
6,542,436 B1 4/2003 Myllyla
6,650,701 B1 11/2003 Hsiang et al.
6,683,960 B1 1/2004 Fujii et al.
6,738,482 B1 5/2004 Jaber
6,766,292 B1 7/2004 Chandran
6,768,795 B2 7/2004 Feltstrom et al.
6,792,107 B2 9/2004 Tucker et al.
6,850,617 B1 2/2005 Weigand
6,940,982 B1 9/2005 Watkins
7,016,504 B1 3/2006 Shennib
7,058,463 B1 6/2006 Ruha et al.
7,103,188 B1 9/2006 Jones
7,181,030 B2 2/2007 Rasmussen et al.
7,330,739 B2 2/2008 Somayajula
7,365,669 B1 4/2008 Melanson
7,466,838 B1 12/2008 Mosely
7,680,456 B2 3/2010 Muhammad et al.
7,742,746 B2 6/2010 Xiang et al.
7,742,790 B2 6/2010 Konchitsky et al.
7,817,808 B2 10/2010 Konchitsky et al.
7,953,231 B2 5/2011 Ishida
8,019,050 B2 9/2011 Mactavish et al.
8,085,966 B2 12/2011 Amsel
D666,169 S 8/2012 Tucker et al.
8,249,262 B2 8/2012 Chua et al.
8,251,903 B2 8/2012 LeBoeuf et al.
8,290,537 B2 10/2012 Lee et al.
8,325,934 B2 12/2012 Kuo
8,331,604 B2 12/2012 Saito et al.
8,374,358 B2 2/2013 Buck et al.
8,379,884 B2 2/2013 Horibe et al.
8,401,200 B2 3/2013 Tiscareno et al.
8,442,251 B2 5/2013 Jensen et al.
8,559,661 B2 10/2013 Tanghe
8,600,085 B2 12/2013 Chen et al.
8,775,172 B2 7/2014 Konchitsky et al.
8,804,974 B1 8/2014 Melanson
8,831,239 B2 9/2014 Bakalos
8,842,848 B2 9/2014 Donaldson et al.
8,855,330 B2 10/2014 Taenzer
8,908,877 B2 12/2014 Abdollahzadeh Milani et al.
8,942,976 B2 1/2015 Li et al.
8,977,545 B2 3/2015 Zeng et al.
9,066,176 B2 6/2015 Hendrix et al.
9,071,724 B2 6/2015 Do et al.
9,082,391 B2 7/2015 Yermeche et al.
9,129,586 B2 9/2015 Bajic et al.
2001/0053228 A1 12/2001 Jones
2002/0003887 A1 1/2002 Zhang et al.
2003/0063759 A1 4/2003 Brennan et al.
2003/0072439 A1 4/2003 Gupta
2003/0185403 A1 10/2003 Sibbald
2004/0047464 A1 3/2004 Yu et al.
2004/0120535 A1* 6/2004 Woods ..... 381/96
2004/0165736 A1 8/2004 Hetherington et al.
2004/0167777 A1 8/2004 Hetherington et al.
2004/0202333 A1 10/2004 Csermak et al.
2004/0240677 A1 12/2004 Onishi et al.
2004/0242160 A1 12/2004 Ichikawa et al.
2004/0264706 A1 12/2004 Ray et al.
2005/0004796 A1 1/2005 Trump et al.
2005/0018862 A1* 1/2005 Fisher ..... 381/98
2005/0117754 A1 6/2005 Sakawaki
2005/0207585 A1 9/2005 Christoph
2005/0240401 A1 10/2005 Ebenezer
2006/0018460 A1 1/2006 McCree
2006/0035593 A1 2/2006 Leeds
2006/0055910 A1 3/2006 Lee
2006/0069556 A1 3/2006 Nadjar et al.
2006/0153400 A1 7/2006 Fujita et al.
2006/0159282 A1 7/2006 Borsch
2006/0161428 A1 7/2006 Fouret
2006/0251266 A1 11/2006 Saunders et al.
2007/0030989 A1 2/2007 Kates
2007/0033029 A1 2/2007 Sakawaki
2007/0038441 A1 2/2007 Inoue et al.
2007/0047742 A1 3/2007 Taenzer et al.
2007/0053524 A1 3/2007 Haulick et al.
2007/0076896 A1 4/2007 Hosaka et al.
2007/0154031 A1 7/2007 Avendano et al.
2007/0258597 A1 11/2007 Rasmussen et al.
2007/0297620 A1 12/2007 Choy
2008/0019548 A1 1/2008 Avendano
2008/0101589 A1 5/2008 Horowitz et al.
2008/0107281 A1* 5/2008 Togami et al. ..... 381/66
2008/0144853 A1 6/2008 Sommerfeldt et al.
2008/0177532 A1* 7/2008 Greiss et al. ..... 704/200.1
2008/0181422 A1 7/2008 Christoph
2008/0226098 A1 9/2008 Haulick et al.
2008/0240413 A1 10/2008 Mohammad et al.

(56) References Cited

U.S. PATENT DOCUMENTS

2008/0240455 A1 10/2008 Inoue et al.
2008/0240457 A1 10/2008 Inoue et al.
2008/0269926 A1 10/2008 Xiang et al.
2009/0012783 A1 1/2009 Klein
2009/0034748 A1 2/2009 Sibbald
2009/0041260 A1 2/2009 Jorgensen et al.
2009/0046867 A1 2/2009 Clemow
2009/0060222 A1 3/2009 Jeong et al.
2009/0080670 A1* 3/2009 Solbeck et al. ..... 381/71.6
2009/0086990 A1 4/2009 Christoph
2009/0175461 A1 7/2009 Nakamura et al.
2009/0175466 A1 7/2009 Elko et al.
2009/0196429 A1 8/2009 Ramakrishnan et al.
2009/0220107 A1 9/2009 Every et al.
2009/0238369 A1 9/2009 Ramakrishnan et al.
2009/0245529 A1 10/2009 Asada et al.
2009/0254340 A1 10/2009 Sun et al.
2009/0290718 A1 11/2009 Kahn et al.
2009/0296965 A1 12/2009 Kojima
2009/0304200 A1 12/2009 Kim et al.
2009/0311979 A1 12/2009 Husted et al.
2010/0002891 A1 1/2010 Shiraishi et al.
2010/0014683 A1 1/2010 Maeda et al.
2010/0014685 A1 1/2010 Wurm
2010/0061564 A1 3/2010 Clemow et al.
2010/0069114 A1 3/2010 Lee et al.
2010/0082339 A1 4/2010 Konchitsky et al.
2010/0098263 A1 4/2010 Pan et al.
2010/0098265 A1* 4/2010 Pan et al. ..... 381/94.1
2010/0124335 A1 5/2010 Wessling et al.
2010/0124336 A1 5/2010 Shridhar et al.
2010/0124337 A1 5/2010 Wertz et al.
2010/0131269 A1 5/2010 Park et al.
2010/0142715 A1 6/2010 Goldstein et al.
2010/0150367 A1 6/2010 Mizuno
2010/0158330 A1* 6/2010 Guissin et al. ..... 382/128
2010/0166203 A1 7/2010 Peissig et al.
2010/0195838 A1 8/2010 Bright
2010/0195844 A1 8/2010 Christoph et al.
2010/0207317 A1 8/2010 Iwami et al.
2010/0239126 A1 9/2010 Grafenberg et al.
2010/0246855 A1 9/2010 Chen
2010/0260345 A1 10/2010 Shridhar et al.
2010/0266137 A1 10/2010 Sibbald et al.
2010/0272276 A1 10/2010 Carreras et al.
2010/0272283 A1 10/2010 Carreras et al.
2010/0274564 A1 10/2010 Bakalos et al.
2010/0284546 A1 11/2010 DeBrunner et al.
2010/0291891 A1 11/2010 Ridgers et al.
2010/0296666 A1 11/2010 Lin
2010/0296668 A1 11/2010 Lee et al.
2010/0310086 A1 12/2010 Magrath et al.
2010/0322430 A1 12/2010 Isberg
2011/0007907 A1 1/2011 Park et al.
2011/0026724 A1 2/2011 Doclo
2011/0099010 A1 4/2011 Zhang
2011/0106533 A1 5/2011 Yu
2011/0116654 A1 5/2011 Chan et al.
2011/0129098 A1 6/2011 Delano et al.
2011/0130176 A1 6/2011 Magrath et al.
2011/0142247 A1 6/2011 Fellers et al.
2011/0144984 A1 6/2011 Konchitsky
2011/0158419 A1 6/2011 Theverapperuma et al.
2011/0206214 A1 8/2011 Christoph et al.
2011/0222698 A1 9/2011 Asao et al.
2011/0249826 A1 10/2011 Van Leest
2011/0288860 A1 11/2011 Schevciw et al.
2011/0293103 A1 12/2011 Park et al.
2011/0299695 A1 12/2011 Nicholson
2011/0305347 A1 12/2011 Wurm
2011/0317848 A1 12/2011 Ivanov et al.
2012/0135787 A1 5/2012 Kusunoki et al.
2012/0140917 A1 6/2012 Nicholson et al.
2012/0140942 A1 6/2012 Loeda
2012/0140943 A1 6/2012 Hendrix et al.
2012/0148062 A1 6/2012 Scarlett et al.
2012/0155666 A1 6/2012 Nair
2012/0170766 A1* 7/2012 Alves et al. ..... 381/71.11
2012/0207317 A1 8/2012 Abdollahzadeh Milani et al.
2012/0215519 A1 8/2012 Park et al.
2012/0250873 A1 10/2012 Bakalos et al.
2012/0259626 A1 10/2012 Li et al.
2012/0263317 A1 10/2012 Shin et al.
2012/0281850 A1 11/2012 Hyatt
2012/0300955 A1 11/2012 Iseki et al.
2012/0300958 A1 11/2012 Klemmensen
2012/0300960 A1 11/2012 Mackay et al.
2012/0308021 A1 12/2012 Kwatra et al.
2012/0308024 A1 12/2012 Alderson et al.
2012/0308025 A1 12/2012 Hendrix et al.
2012/0308026 A1 12/2012 Kamath et al.
2012/0308027 A1 12/2012 Kwatra
2012/0308028 A1 12/2012 Kwatra et al.
2012/0310640 A1 12/2012 Kwatra et al.
2013/0010982 A1 1/2013 Elko et al.
2013/0083939 A1 4/2013 Fellers et al.
2013/0195282 A1 8/2013 Ohita et al.
2013/0243198 A1 9/2013 Van Rumpt
2013/0243225 A1 9/2013 Yokota
2013/0272539 A1 10/2013 Kim et al.
2013/0287218 A1 10/2013 Alderson et al.
2013/0287219 A1 10/2013 Hendrix et al.
2013/0301842 A1 11/2013 Hendrix et al.
2013/0301847 A1 11/2013 Alderson et al.
2013/0301848 A1 11/2013 Zhou et al.
2013/0301849 A1 11/2013 Alderson et al.
2013/0315403 A1 11/2013 Samuelsson
2013/0343556 A1 12/2013 Bright
2013/0343571 A1 12/2013 Rayala et al.
2014/0016803 A1 1/2014 Puskarich
2014/0036127 A1 2/2014 Pong et al.
2014/0044275 A1 2/2014 Goldstein et al.
2014/0050332 A1 2/2014 Nielsen et al.
2014/0072134 A1 3/2014 Po et al.
2014/0086425 A1 3/2014 Jensen et al.
2014/0146976 A1 5/2014 Rundle
2014/0169579 A1 6/2014 Azmi
2014/0177851 A1 6/2014 Kitazawa et al.
2014/0211953 A1 7/2014 Alderson et al.
2014/0270222 A1 9/2014 Hendrix et al.
2014/0270223 A1 9/2014 Li et al.
2014/0270224 A1 9/2014 Zhou et al.
2014/0294182 A1 10/2014 Axelsson et al.
2014/0307887 A1 10/2014 Alderson
2014/0307888 A1 10/2014 Alderson et al.
2014/0307890 A1 10/2014 Zhou et al.
2014/0314244 A1 10/2014 Yong
2014/0314247 A1 10/2014 Zhang
2014/0369517 A1 12/2014 Zhou et al.
2015/0092953 A1 4/2015 Abdollahzadeh Milani et al.
2015/0161981 A1 6/2015 Kwatra

FOREIGN PATENT DOCUMENTS

EP 1691577 A2 8/2006
EP 1880699 A2 1/2008
EP 1947642 A1 7/2008
EP 2133866 A1 12/2009
EP 2216774 A1 8/2010
EP 2237573 A1 10/2010
EP 2395500 A1 12/2011
EP 2395501 A1 12/2011
EP 2551845 A1 1/2013
GB 2401744 A 11/2004
GB 2436657 A 10/2007
GB 2455821 A 6/2009
GB 2455824 A 6/2009
GB 2455828 A 6/2009
GB 2484722 A 4/2012
JP H06-186985 A 7/1994
JP 07104769 4/1995
JP 07240989 9/1995
JP 07325588 12/1995
JP H11305783 A 11/1999

(56) References Cited

FOREIGN PATENT DOCUMENTS

| | | | |
|---|---|---|---|
| JP | 2008015046 | A | 1/2008 |
| WO | WO 9113429 | | 9/1991 |
| WO | WO 9911045 | | 3/1999 |
| WO | WO 03/015074 | A1 | 2/2003 |
| WO | WO 03015275 | A1 | 2/2003 |
| WO | WO 2004009007 | A1 | 1/2004 |
| WO | WO 2004017303 | A1 | 2/2004 |
| WO | WO 2006128768 | A1 | 12/2006 |
| WO | WO 2007007916 | A1 | 1/2007 |
| WO | WO 2007011337 | | 1/2007 |
| WO | WO 2007110807 | A2 | 10/2007 |
| WO | WO 2007113487 | A1 | 11/2007 |
| WO | WO 2010117714 | A1 | 10/2010 |
| WO | WO 2010131154 | A1 | 11/2010 |
| WO | WO 2012134874 | A1 | 10/2012 |
| WO | WO 2015038255 | A1 | 3/2015 |

OTHER PUBLICATIONS

Peters, Robert W., "The Effect of High-Pass and Low-Pass Filtering of Side-Tone Upon Speaker Intelligibility", Project Report No. NM 001 064.01.25, Research Report of the U.S. Naval School of Aviation Medicine, Aug. 16, 1954, 13 pages (pp. 1-13 in pdf), Pensacola, FL, US.

U.S. Appl. No. 14/197,814, filed Mar. 5, 2014, Kaller, et al.

U.S. Appl. No. 14/210,537, filed Mar. 14, 2014, Abdollahzadeh Milani, et al.

U.S. Appl. No. 14/210,589, filed Mar. 14, 2014, Abdollahzadeh Milani, et al.

Lane, et al., "Voice Level: Autophonic Scale, Perceived Loudness, and the Effects of Sidetone", The Journal of the Acoustical Society of America, Feb. 1961, pp. 160-167, vol. 33, No. 2., Cambridge, MA, US.

Liu, et al., "Compensatory Responses to Loudness-shifted Voice Feedback During Production of Mandarin Speech", Journal of the Acoustical Society of America, Oct. 2007, pp. 2405-2412, vol. 122, No. 4.

Paepcke, et al., "Yelling in the Hall: Using Sidetone to Address a Problem with Mobile Remote Presence Systems", Symposium on User Interface Software and Technology, Oct. 16-19, 2011, 10 pages (pp. 1-10 in pdf), Santa Barbara, CA, US.

Therrien, et al., "Sensory Attenuation of Self-Produced Feedback: The Lombard Effect Revisited", PLOS ONE, Nov. 2012, pp. 1-7, vol. 7, Issue 11, e49370, Ontario, Canada.

Abdollahzadeh Milani, et al., "On Maximum Achievable Noise Reduction in ANC Systems",2010 IEEE International Conference on Acoustics Speech and Signal Processing. Mar. 14-19, 2010, pp. 349-352, Dallas, TX, US.

U.S. Appl. No. 14/228,322, filed Mar. 28, 2014, Alderson, et al.

U.S. Appl. No. 13/762,504, filed Feb. 8, 2013, Abdollahzadeh Milani, et al.

U.S. Appl. No. 13/721,832, filed Dec. 20, 2012, Lu, et al.

U.S. Appl. No. 13/724,656, filed Dec. 21, 2012, Lu, et al.

U.S. Appl. No. 14/252,235, filed Apr. 14, 2014, Lu, et al.

U.S. Appl. No. 13/968,013, filed Aug. 15, 2013, Abdollahzadeh Milani, et al.

U.S. Appl. No. 13/924,935, filed Jun. 24, 2013, Hellman.

U.S. Appl. No. 13/896,526, filed May 17, 2013, Naderi.

U.S. Appl. No. 14/101,955, filed Dec. 10, 2013, Alderson.

U.S. Appl. No. 14/101,777, filed Dec. 10, 2013, Alderson et al.

Cohen, Israel, "Noise Spectrum Estimation in Adverse Environments: Improved Minima Controlled Recursive Averaging", IEEE Transactions on Speech and Audio Processing, Sep. 2003, pp. 1-11, vol. 11, Issue 5, Piscataway, NJ, US.

Ryan, et al., "Optimum Near-Field Performance of Microphone Arrays Subject to a Far-Field Beampattern Constraint", J. Acoust. Soc. Am., Nov. 2000, pp. 2248-2255, 108 (5), Pt. 1, Ottawa, Ontario, Canada.

Cohen, et al., "Noise Estimation by Minima Controlled Recursive Averaging for Robust Speech Enhancement", IEEE Signal Processing Letters, Jan. 2002, pp. 12-15, vol. 9, No. 1, Piscataway, NJ, US.

Martin, Rainer, "Noise Power Spectral Density Estimation Based on Optimal Smoothing and Minimum Statistics", IEEE Transactions on Speech and Audio Processing, Jul. 2001, pp. 504-512, vol. 9, No. 5, Piscataway, NJ, US.

Martin, Rainer, "Spectral Subtraction Based on Minimum Statistics", Signal Processing VII Theories and Applications, Proceedings of EUSIPCO-94, 7th European Signal Processing Conference, Sep. 13-16, 1994, pp. 1182-1185, vol. III, Edinburgh, Scotland, U.K.

Booij, et al., "Virtual sensors for local, three dimensional, broadband multiple-channel active noise control and the effects on the quiet zones", Proceedings of the International Conference on Noise and Vibration Engineering, ISMA 2010, Sep. 20-22, 2010, pp. 151-166, Leuven.

Kuo, et al., "Residual noise shaping technique for active noise control systems", J. Acoust. Soc. Am. 95 (3), Mar. 1994, pp. 1665-1668.

Lopez-Caudana, Edgar Omar, "Active Noise Cancellation: The Unwanted Signal and the Hybrid Solution", Adaptive Filtering Applications, Dr. Lino Garcia (Ed.), Jul. 2011, pp. 49-84, ISBN: 978-953-307-306-4, InTech.

Senderowicz, et al., "Low-Voltage Double-Sampled Delta-Sigma Converters", IEEE Journal on Solid-State Circuits, Dec. 1997, pp. 1907-1919, vol. 32, No. 12, Piscataway, NJ.

Hurst, et al., "An improved double sampling scheme for switched-capacitor delta-sigma modulators", 1992 IEEE Int. Symp. on Circuits and Systems, May 10-13, 1992, vol. 3, pp. 1179-1182, San Diego, CA.

U.S. Appl. No. 13/686,353, filed Nov. 27, 2012, Hendrix, et al.

U.S. Appl. No. 13/795,160, filed Mar. 12, 2013, Hendrix, et al.

U.S. Appl. No. 13/692,367, filed Dec. 3, 2012, Alderson, et al.

U.S. Appl. No. 13/722,119, filed Dec. 20, 2012, Hendrix, et al.

U.S. Appl. No. 13/727,718, filed Dec. 27, 2012, Alderson, et al.

U.S. Appl. No. 13/787,906, filed Mar. 7, 2013, Alderson, et al.

U.S. Appl. No. 13/729,141, filed Dec. 28, 2012, Zhou, et al.

U.S. Appl. No. 13/794,931, filed Mar. 12, 2013, Lu, et al.

U.S. Appl. No. 13/794,979, filed Mar. 12, 2013, Alderson, et al.

Pfann, et al., "LMS Adaptive Filtering with Delta-Sigma Modulated Input Signals," IEEE Signal Processing Letters, Apr. 1998, pp. 95-97, vol. 5, No. 4, IEEE Press, Piscataway, NJ.

Toochinda, et al. "A Single-Input Two-Output Feedback Formulation for ANC Problems," Proceedings of the 2001 American Control Conference, Jun. 2001, pp. 923-928, vol. 2, Arlington, VA.

Kuo, et al., "Active Noise Control: A Tutorial Review," Proceedings of the IEEE, Jun. 1999, pp. 943-973, vol. 87, No. 6, IEEE Press, Piscataway, NJ.

Johns, et al., "Continuous-Time LMS Adaptive Recursive Filters," IEEE Transactions on Circuits and Systems, Jul. 1991, pp. 769-778, vol. 38, No. 7, IEEE Press, Piscataway, NJ.

Shoval, et al., "Comparison of DC Offset Effects in Four LMS Adaptive Algorithms," IEEE Transactions on Circuits and Systems II: Analog and Digital Processing, Mar. 1995, pp. 176-185, vol. 42, Issue 3, IEEE Press, Piscataway, NJ.

Mali, Dilip, "Comparison of DC Offset Effects on LMS Algorithm and its Derivatives," International Journal of Recent Trends in Engineering, May 2009, pp. 323-328, vol. 1, No. 1, Academy Publisher.

Kates, James M., "Principles of Digital Dynamic Range Compression," Trends in Amplification, Spring 2005, pp. 45-76, vol. 9, No. 2, Sage Publications.

Gao, et al., "Adaptive Linearization of a Loudspeaker," IEEE International Conference on Acoustics, Speech, and Signal Processing, Apr. 14-17, 1991, pp. 3589-3592, Toronto, Ontario, CA.

Silva, et al., "Convex Combination of Adaptive Filters With Different Tracking Capabilities," IEEE International Conference on Acoustics, Speech, and Signal Processing, Apr. 15-20, 2007, pp. III 925-928, vol. 3, Honolulu, HI, USA.

Akhtar, et al., "A Method for Online Secondary Path Modeling in Active Noise Control Systems," IEEE International Symposium on Circuits and Systems, May 23-26, 2005, pp. 264-267, vol. 1, Kobe, Japan.

(56) References Cited

OTHER PUBLICATIONS

Davari, et al., "A New Online Secondary Path Modeling Method for Feedforward Active Noise Control Systems," IEEE International Conference on Industrial Technology, Apr. 21-24, 2008, pp. 1-6, Chengdu, China.
Lan, et al., "An Active Noise Control System Using Online Secondary Path Modeling With Reduced Auxiliary Noise," IEEE Signal Processing Letters, Jan. 2002, pp. 16-18, vol. 9, Issue 1, IEEE Press, Piscataway, NJ.
Liu, et al., "Analysis of Online Secondary Path Modeling With Auxiliary Noise Scaled by Residual Noise Signal," IEEE Transactions on Audio, Speech and Language Processing, Nov. 2010, pp. 1978-1993, vol. 18, Issue 8, IEEE Press, Piscataway, NJ.
Campbell, Mikey, "Apple looking into self-adjusting earbud headphones with noise cancellation tech", Apple Insider, Jul. 4, 2013, pp. 1-10 (10 pages in pdf), downloaded on May 14, 2014 from http://appleinsider.com/articles/13/07/04/apple-looking-into-self-adjusting-earbud-headphones-with-noise-cancellation-tech.
Jin, et al. "A simultaneous equation method-based online secondary path modeling algorithm for active noise control", Journal of Sound and Vibration, Apr. 25, 2007, pp. 455-474, vol. 303, No. 3-5, London, GB.
Erkelens, et al., "Tracking of Nonstationary Noise Based on Data-Driven Recursive Noise Power Estimation", IEEE Transactions on Audio Speech and Language Processing, Aug. 2008, pp. 1112-1123, vol. 16, No. 6, Piscataway, NJ, US.
Rao, et al., "A Novel Two State Single Channel Speech Enhancement Technique", India Conference (INDICON) 2011 Annual IEEE, IEEE, Dec. 2011, 6 pages (pp. 1-6 in pdf), Piscataway, NJ, US.
Rangachari, et al., "A noise-estimation algorithm for highly non-stationary environments", Speech Communication, Feb. 2006, pp. 220-231, vol. 48, No. 2. Elsevier Science Publishers.
U.S. Appl. No. 13/968,007, filed Aug. 15, 2013, Hendrix, et al.
U.S. Appl. No. 14/029,159, filed Sep. 17, 2013, Li, et al.
U.S. Appl. No. 14/062,951, filed Oct. 25, 2013, Zhou, et al.
Parkins, et al., "Narrowband and broadband active control in an enclosure using the acoustic energy density", J. Acoust. Soc. Am. Jul. 2000, pp. 192-203, vol. 108, issue 1, US.
Feng, et al.., "A broadband self-tuning active noise equaliser", Signal Processing, Oct. 1, 1997, pp. 251-256, vol. 62, No. 2, Elsevier Science Publishers B.V. Amsterdam, NL.
Zhang, et al., "A Robust Online Secondary Path Modeling Method with Auxiliary Noise Power Scheduling Strategy and Norm Constraint Manipulation", IEEE Transactions on Speech and Audio Processing, IEEE Service Center, Jan. 1, 2003, pp. 45-53, vol. 11, No. 1, NY.
Lopez-Gaudana, et al., "A hybrid active noise cancelling with secondary path modeling", 51st Midwest Symposium on Circuits and Systems, MWSCAS 2008, Aug. 10-13, 2008, pp. 277-280, IEEE, Knoxville, TN.
International Search Report and Written Opinion in PCT/US2013/037049, mailed on Mar. 21, 2014, 22 pages (pp. 1-22 in pdf).
U.S. Appl. No. 14/578,567, filed Dec. 22, 2014, Kwatra, et al.
Widrow, B., et al., Adaptive Noise Cancelling; Principles and Applications, Proceedings of the IEEE, Dec. 1975, pp. 1692-1716, vol. 63, No. 13, IEEE, New York, NY, US.
Morgan, et al., A Delayless Subband Adaptive Filter Architecture, IEEE Transactions on Signal Processing, IEEE Service Center, Aug. 1995, pp. 1819-1829, vol. 43, No. 8, New York, NY, US.
Written Opinion of the International Preliminary Examining Authority in PCT/US2013/037049 mailed on Oct. 14, 2014, 7 pages (pp. 1-7 in pdf).
International Preliminary Report on Patentability in PCT/US2013/037049 mailed on Dec. 2, 2014, 23 pages (pp. 1-23 in pdf).
U.S. Appl. No. 14/656,124, filed Mar. 12, 2015, Hendrix, et al.
U.S. Appl. No. 14/734,321, filed Jun. 9, 2015, Alderson, et al.
U.S. Appl. No. 14/840,831, filed Aug. 31, 2015, Hendrix, et al.
Rafaely, Boaz, "Active Noise Reducing Headset—an Overview", The 2001 International Congress and Exhibition on Noice Control Engineering, Aug. 27-30, 2001, 10 pages (pp. 1-10 in pdf), The Netherlands.
Ray, et al., "Hybrid Feedforward-Feedback Active Noise Reduction for Hearing Protection and Communication", The Journal of the Acoustical Society of America, American Institute of Physics for the Acoustical Society of America, Jan. 2006, pp. 2026-2036, vol. 120, No. 4, New York, NY.

* cited by examiner

FREQUENCY AND DIRECTION-DEPENDENT AMBIENT SOUND HANDLING IN PERSONAL AUDIO DEVICES HAVING ADAPTIVE NOISE CANCELLATION (ANC)

This U.S. Patent Application Claims priority under 35 U.S.C. §119(e) to U.S. Provisional Patent Application Ser. No. 61/645,244 filed on May 10, 2012.

BACKGROUND OF THE INVENTION

1. Field of the Invention

The present invention relates generally to personal audio devices such as wireless telephones that include noise cancellation, and more specifically, to a personal audio device in which frequency or direction-dependent characteristics in the ambient sounds are detected and action is taken on the anti-noise signal in response thereto.

2. Background of the Invention

Wireless telephones, such as mobile/cellular telephones, cordless telephones, and other consumer audio devices, such as MP3 players and headphones or earbuds, are in widespread use. Performance of such devices with respect to intelligibility can be improved by providing noise canceling using a microphone to measure ambient acoustic events and then using signal processing to insert an anti-noise signal into the output of the device to cancel the ambient acoustic events.

Since the acoustic environment around personal audio devices such as wireless telephones can change dramatically, depending on the sources of noise that are present and the position of the device itself, it is desirable to adapt the noise canceling to take into account such environmental changes. However, adaptive noise canceling can be ineffective or may provide unexpected results for certain ambient sounds.

Therefore, it would be desirable to provide a personal audio device, including a wireless telephone, that provides effective noise cancellation in the presence of certain ambient sounds.

SUMMARY OF THE INVENTION

The above-stated objective of providing a personal audio device providing noise cancellation in the presence of certain ambient sounds, is accomplished in a personal audio device, a method of operation, and an integrated circuit. The method is a method of operation of the personal audio device and the integrated circuit, which can be incorporated within the personal audio device.

The personal audio device includes a housing, with a transducer mounted on the housing for reproducing an audio signal that includes both source audio for playback to a listener and an anti-noise signal for countering the effects of ambient audio sounds in an acoustic output of the transducer. At least one microphone is mounted on the housing to provide a microphone signal indicative of the ambient audio sounds. The personal audio device further includes an adaptive noise-canceling (ANC) processing circuit within the housing for adaptively generating an anti-noise signal from the microphone signal such that the anti-noise signal causes substantial cancellation of the ambient audio sounds at a transducer. An error microphone may be included for controlling the adaptation of the anti-noise signal to cancel the ambient audio sounds and for compensating for the electro-acoustic path from the output of the processing circuit through the transducer. The ANC processing circuit detects ambient sounds having a frequency-dependent characteristic and takes action on the adaptation of the ANC circuit to avoid generating anti-noise that is disruptive, ineffective or that otherwise compromises performance.

In another aspect, the ANC processing circuit detects a direction of the ambient sounds, with or without detecting the frequency-dependent characteristic, and also takes action on adaptation of the ANC circuit to avoid generating anti-noise that is disruptive, ineffective or that otherwise compromises performance.

The foregoing and other objectives, features, and advantages of the invention will be apparent from the following, more particular, description of the preferred embodiment of the invention, as illustrated in the accompanying drawings.

DESCRIPTION OF ILLUSTRATIVE EMBODIMENT

Noise canceling techniques and circuits that can be implemented in a personal audio device, such as a wireless telephone, are disclosed. The personal audio device includes an adaptive noise canceling (ANC) circuit that measures the ambient acoustic environment and generates a signal that is injected into the speaker (or other transducer) output to cancel ambient acoustic events. However, for some acoustic events or directionality, ordinary operation of the ANC circuit may lead to improper adaptation and erroneous operation. The exemplary personal audio devices, methods and circuits shown below detect ambient audio sounds having particular frequency characteristics or direction and take action on the adaptation of the ANC circuit to avoid undesirable operation. In particular, high frequency content, such as motor hiss in an automotive context, may not cancel well due to unknowns in the high-frequency response of the coupling between the transducer, the error microphone that measures the transducer output and the user's ear. Low frequency content, such as car noise rumble, is also not easily canceled below a certain frequency at which the transducer's ability to reproduce the anti-noise signal diminishes, and the frequency at which the low-frequency response diminishes depending on whether earphones or a built-in speaker of the wireless telephone is being used.

Figure 1:
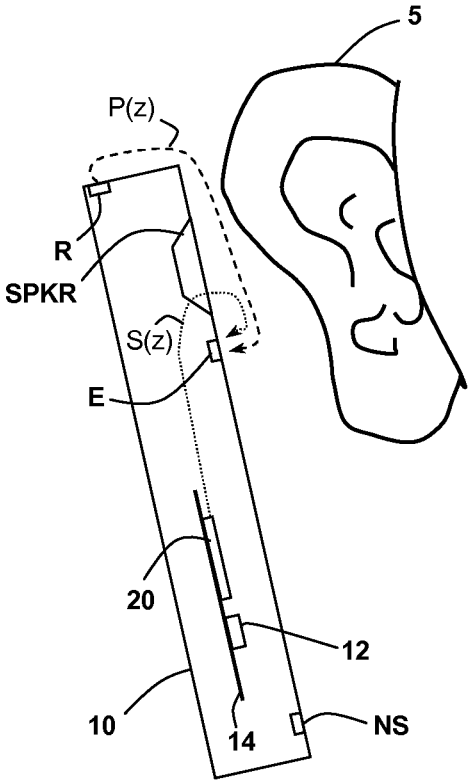
FIG. 1 is an illustration of an exemplary wireless telephone 10.

FIG. 1 shows an exemplary wireless telephone 10 in proximity to a human ear 5. Illustrated wireless telephone 10 is an example of a device in which techniques illustrated herein may be employed, but it is understood that not all of the elements or configurations embodied in illustrated wireless telephone 10, or in the circuits depicted in subsequent illustrations, are required. Wireless telephone 10 includes a transducer, such as speaker SPKR, that reproduces distant speech received by wireless telephone 10, along with other local audio events such as ringtones, stored audio program material, near-end speech, sources from web-pages or other network communications received by wireless telephone 10 and audio indications such as battery low and other system event notifications. A near-speech microphone NS is provided to capture near-end speech, which is transmitted from wireless telephone 10 to the other conversation participant(s).

Wireless telephone 10 includes adaptive noise canceling (ANC) circuits and features that inject an anti-noise signal into speaker SPKR to improve intelligibility of the distant speech and other audio reproduced by speaker SPKR. A reference microphone R is provided for measuring the ambient acoustic environment and is positioned away from the typical position of a user's/talker's mouth, so that the near-end speech is minimized in the signal produced by reference microphone R. A third microphone, error microphone E, is provided in order to further improve the ANC operation by providing a measure of the ambient audio combined with the audio signal reproduced by speaker SPKR close to ear 5, when wireless telephone 10 is in close proximity to ear 5. Exemplary circuit 14 within wireless telephone 10 includes an audio CODEC integrated circuit 20 that receives the signals from reference microphone R, near speech microphone NS, and error microphone E and interfaces with other integrated circuits such as an RF integrated circuit 12 containing the wireless telephone transceiver. In other embodiments of the invention, the circuits and techniques disclosed herein may be incorporated in a single integrated circuit that contains control circuits and other functionality for implementing the entirety of the personal audio device, such as an MP3 player-on-a-chip integrated circuit.

In general, the ANC techniques disclosed herein measure ambient acoustic events (as opposed to the output of speaker SPKR and/or the near-end speech) impinging on reference microphone R, and by also measuring the same ambient acoustic events impinging on error microphone E, the ANC processing circuits of illustrated wireless telephone 10 adapt an anti-noise signal generated from the output of reference microphone R to have a characteristic that minimizes the amplitude of the ambient acoustic events present at error microphone E. Since acoustic path P(z) extends from reference microphone R to error microphone E, the ANC circuits are essentially estimating acoustic path P(z) combined with removing effects of an electro-acoustic path S(z). Electro-acoustic path S(z) represents the response of the audio output circuits of CODEC IC 20 and the acoustic/electric transfer function of speaker SPKR including the coupling between speaker SPKR and error microphone E in the particular acoustic environment. Electro-acoustic path S(z) is affected by the proximity and structure of ear 5 and other physical objects and human head structures that may be in proximity to wireless telephone 10, when wireless telephone 10 is not firmly pressed to ear 5. While the illustrated wireless telephone 10 includes a two microphone ANC system with a third near speech microphone NS, other systems that do not include separate error and reference microphones can implement the above-described techniques. Alternatively, near speech microphone NS can be used to perform the function of the reference microphone R in the above-described system. Finally, in personal audio devices designed only for audio playback, near speech microphone NS will generally not be included, and the near-speech signal paths in the circuits described in further detail below can be omitted.

Figure 2:
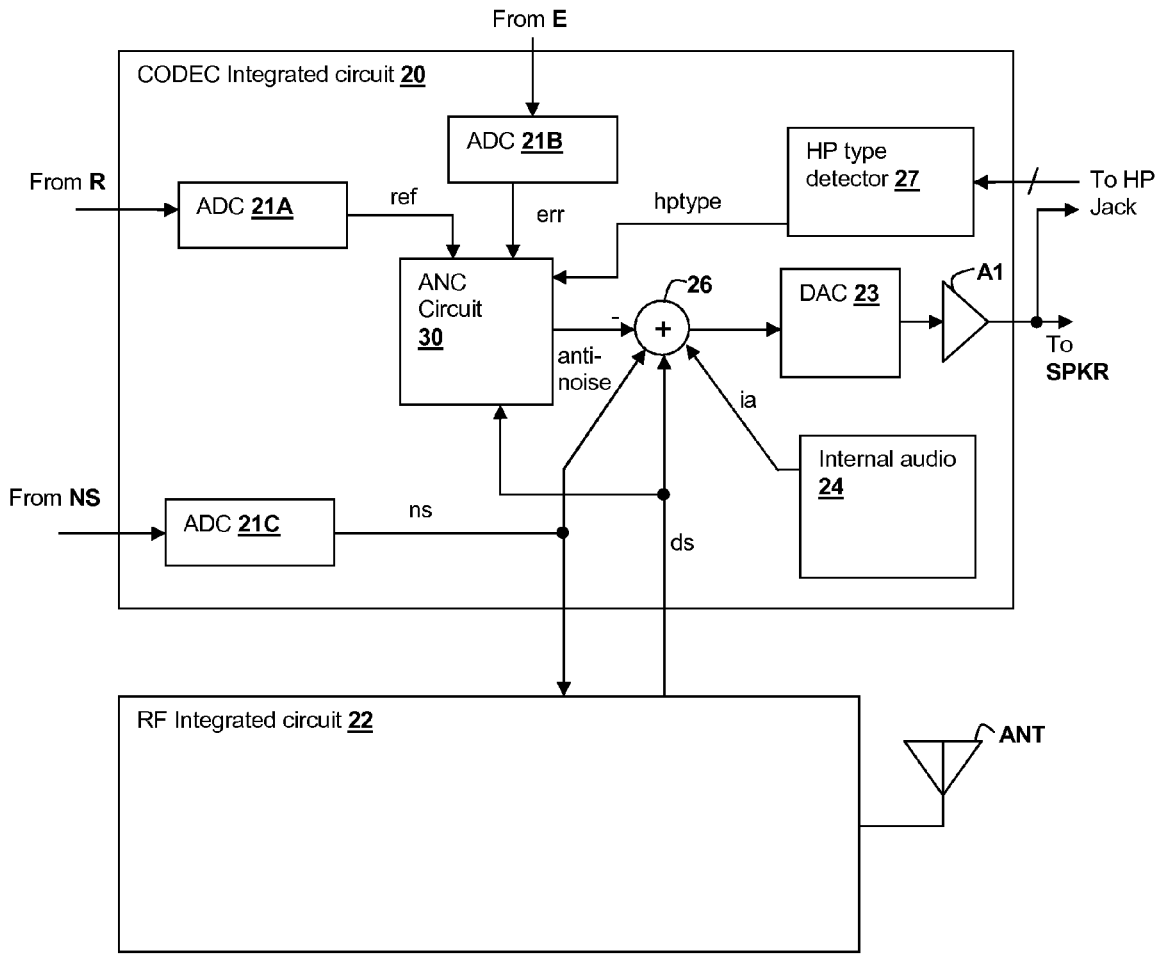
FIG. 2 is a block diagram of circuits within wireless telephone 10.

Referring now to FIG. 2, circuits within wireless telephone 10 are shown in a block diagram. CODEC integrated circuit 20 includes an analog-to-digital converter (ADC) 21A for receiving the reference microphone signal and generating a digital representation ref of the reference microphone signal, an ADC 21B for receiving the error microphone signal and generating a digital representation err of the error microphone signal, and an ADC 21C for receiving the near speech microphone signal and generating a digital representation of near speech microphone signal ns. CODEC IC 20 generates an output for driving speaker SPKR or headphones from an amplifier A1, which amplifies the output of a digital-to-analog converter (DAC) 23 that receives the output of a combiner 26. A headphone type detector 27 provides information via control signal hptype to ANC circuit 30 about whether a headset is connected, and optionally a type of the headset that is connected. Details of headset type detection techniques that may be used to implement headphone type detector 27 are disclosed in U.S. patent application Ser. No. 13/588,021 entitled "HEADSET TYPE DETECTION AND CONFIGURATION TECHNIQUES," the disclosure of which is incorporated herein by reference. Combiner 26 combines audio signals ia from internal audio sources 24, the anti-noise signal anti-noise generated by ANC circuit 30, which by convention has the same polarity as the noise in reference microphone signal ref and is therefore subtracted by combiner 26. Additionally, combiner 26 also combines a portion of near speech signal ns so that the user of wireless telephone 10 hears their own voice in proper relation to downlink speech ds, which is received from radio frequency (RF) integrated circuit 22. In the exemplary circuit, downlink speech ds is provided to ANC circuit 30. The downlink speech ds and internal audio ia are provided to combiner 26 to provide source audio (ds+ia), so that source audio (ds+ia) may be presented to estimate acoustic path S(z) with a secondary path adaptive filter within ANC circuit 30. Near speech signal ns is also provided to RF integrated circuit 22 and is transmitted as uplink speech to the service provider via antenna ANT.

Figure 3A:
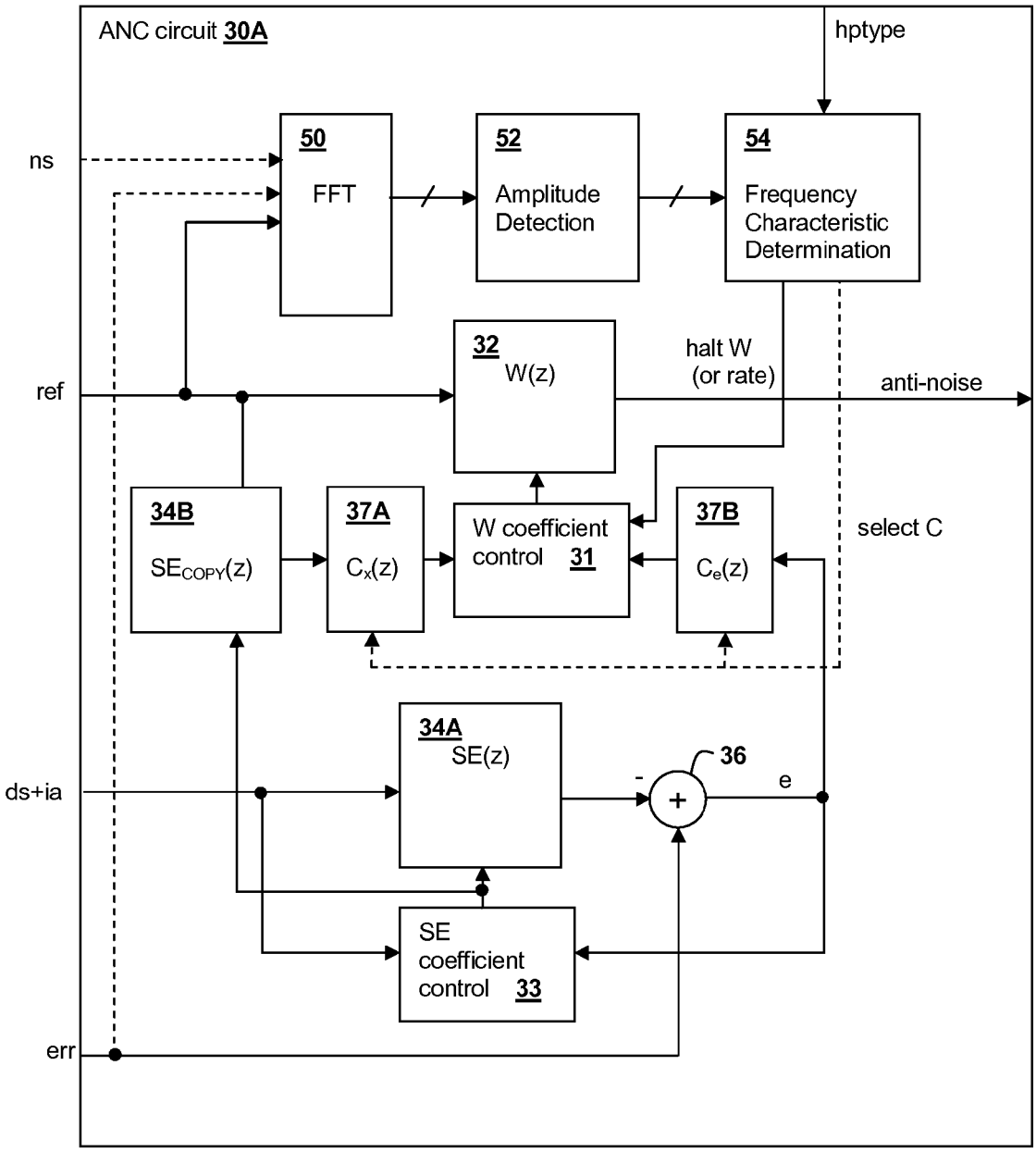
FIGS. 3A-3C are block diagrams depicting signal processing circuits and functional blocks of various exemplary ANC circuits that can be used to implement ANC circuit 30 of CODEC integrated circuit 20 of FIG. 2.

FIG. 3A shows one example of details of an ANC circuit 30A that can be used to implement ANC circuit 30 of FIG. 2. An adaptive filter 32 receives reference microphone signal ref and under ideal circumstances, adapts its transfer function W(z) to be P(z)/S(z) to generate anti-noise signal anti-noise, which is provided to an output combiner that combines the anti-noise signal with the audio signal to be reproduced by the transducer, as exemplified by combiner 26 of FIG. 2. The coefficients of adaptive filter 32 are controlled by a W coefficient control block 31 that uses a correlation of two signals to determine the response of adaptive filter 32, which generally minimizes the error, in a least-mean squares sense, between those components of reference microphone signal ref present in error microphone signal err. The signals processed by W coefficient control block 31 are the reference microphone signal ref as shaped by a copy of an estimate of the response of path S(z) provided by filter 34B and another signal that includes error microphone signal err. By transforming reference microphone signal ref with a copy of the estimate of the response of path S(z), response $SE_{COPY}(z)$, and minimizing error microphone signal err after removing components of error microphone signal err due to playback of source audio, adaptive filter 32 adapts to the desired response of P(z)/S(z). A filter 37A, that has a response $C_x(z)$ as explained in further detail below, processes the output of filter 34B and provides the first input to W coefficient control block 31. The second input to W coefficient control block 31 is processed by another filter 37B having a response of $C_e(z)$. Response $C_e(z)$ has a phase response matched to response $C_x(z)$ of filter 37A. The input to filter 37B includes error microphone signal err and an inverted amount of downlink audio signal ds that has been processed by filter response SE(z), of which response $SE_{COPY}(z)$ is a copy. Responses $C_e(z)$ and $C_x(z)$ are shaped to perform various functions. One of the functions of responses $C_e(z)$ and $C_x(z)$ is to remove low frequency components and offset that will cause improper operation and serve no purpose in the ANC system, as the response of the anti-noise signal is limited by the response of transducer SPKR. Another function of responses $C_e(z)$ and $C_x(z)$ is to bias the adaptation of the ANC system at higher frequencies where cancellation may or may not be effective depending on conditions.

In addition to error microphone signal err, the other signal processed along with the output of filter 34B by W coefficient control block 31 includes an inverted amount of the source audio (ds+ia) including downlink audio signal ds and internal audio ia that has been processed by filter response SE(z), of which response $SE_{COPY}(z)$ is a copy. By injecting an inverted amount of source audio, adaptive filter 32 is prevented from adapting to the relatively large amount of source audio present in error microphone signal err. By transforming the inverted copy of downlink audio signal ds and internal audio ia with the estimate of the response of path S(z), the source audio that is removed from error microphone signal err before processing should match the expected version of source audio (ds+ia) present in error microphone signal err. The portion of source audio (ds+ia) that is removed matches the source audio (ds+ia) present in error microphone signal err because the electrical and acoustical path of S(z) is the path taken by downlink audio signal ds and internal audio ia to arrive at error microphone E. Filter 34B is not an adaptive filter, per se, but has an adjustable response that is tuned to match the response of adaptive filter 34A, so that the response of filter 34B tracks the adapting of adaptive filter 34A. To implement the above, adaptive filter 34A has coefficients controlled by SE coefficient control block 33, which processes the source audio (ds+ia) and error microphone signal err, after a combiner 36 removes the above-described filtered source audio (ds+ia) that has been filtered by adaptive filter 34A to represent the expected source audio delivered to error microphone E from error signal e. Adaptive filter 34A is thereby adapted to generate an error signal e from downlink audio signal ds and internal audio ia, that when subtracted from error microphone signal err, contains the content of error microphone signal err that is not due to source audio (ds+ia).

In order to avoid ineffective and generally disruptive ANC operation when the ambient audio sounds contain frequency-dependent characteristics that cannot be effectively canceled by ANC circuit 30A, ANC circuit 30A includes a fast-Fourier transform (FFT) block 50 that filters the reference microphone signal ref into a number of discrete frequency bins, and an amplitude detection block 52 that provides an indication of the energy of the reference microphone signal in each of the bins. The outputs of amplitude detection block 52 are provided to a frequency characteristic determination logic 54 that determines whether energy is present in one or more frequency bands of reference microphone signal ref in which ANC operation can be expected to be ineffective or cause erroneous adaptation or noise-cancellation. Which frequency bands are of interest may be programmable and may be selectable in response to various configurations of personal audio device 10. For example, different frequency bands may be selected depending on control signal hptype indicating what type of headset is connected to personal audio device 10, or ambient sound frequency characteristic detection might be disabled if a headset is connected. Depending on whether selected or predetermined frequency characteristics are present in reference microphone signal ref, frequency characteristic determination logic 54 takes action to prevent the improper adaptation/operation of the ANC circuit. Specifically, in the example given in FIG. 3A, frequency characteristic determination logic 54 halts operation of W coefficient control block 31 by asserting control signal halt W. Alternatively, or in combination control signal haltW may be replaced or supplemented with a rate control signal rate that lowers an update rate of W coefficient control block 31 when frequency characteristic determination logic 54 indicates that a particular frequency-dependent characteristic has been detected in the ambient sounds. As another alternative, frequency characteristic determination logic 54 may alter adaptation of response W(z) of adaptive filter 32 by selecting from among multiple responses for response $C_e(z)$ of filter 37B and response $C_x(z)$ of filter 37A, so that, depending on frequency dependent characteristics of the actual ambient signal received at reference microphone r, the responsiveness of coefficient control block 31 at particular frequencies can be changed, so that adaptation can be increased or decreased depending on the frequency content of the ambient sounds detected by ANC circuit 30A. While the illustrative example uses an analysis of only reference microphone signal ref to detect the frequency-dependent characteristics of the ambient sounds, near-speech microphone NS can be used, as long as actual near-speech conditions are properly handled, and alternatively error microphone E can be used under certain conditions or at frequencies for which the user's ear does not occlude the ambient sounds. Further, multiple microphones, including duplicate reference microphones, can be used to provide input to fast-Fourier transform (FFT) block 50, which alternatively may use other filtering/analysis techniques such as discrete-Fourier transform (DFT) or a parallel set of filters such as infinite-impulse response (IIR) band-pass filters.

Figure 3B:
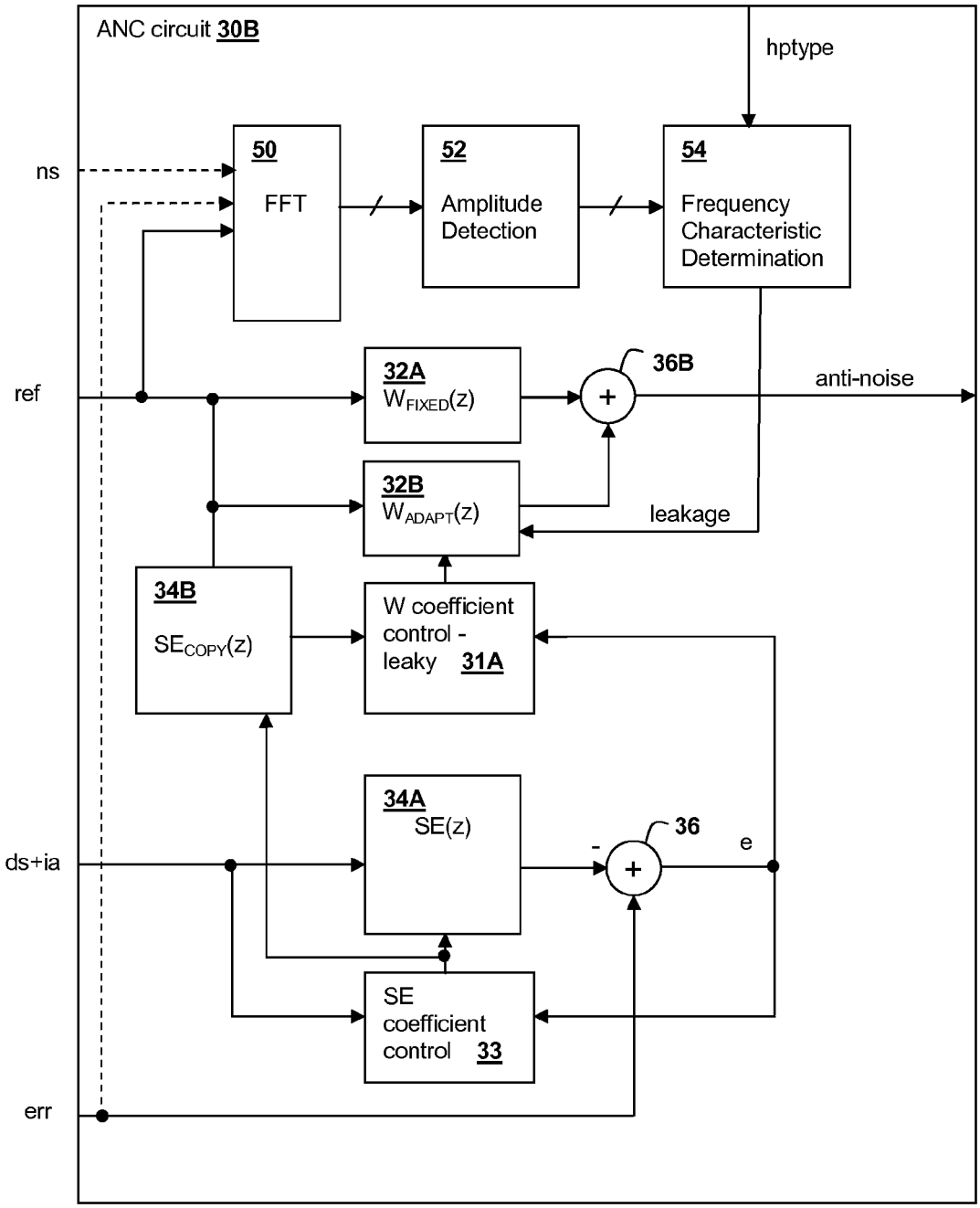

Referring now to FIG. 3B, details of another ANC circuit 30B that may alternatively be used to implement ANC circuit 30 of FIG. 2. ANC circuit 30B is similar to ANC circuit 30A of FIG. 3A, so only differences between them will be described below. In ANC circuit 30B, rather than employing an adaptive filter to implement response W(z) in ANC circuit 30B, a fixed response $W_{FIXED}(x)$ is provided by filter 32A and an adaptive portion of the response $W_{ADAPT}(Z)$ is provided by adaptive filter 32B. The outputs of filters 32A and 32B are combined by combiner 36B to provide a total response that has a fixed and an adaptive portion. W coefficient control block 31A has a controllable leaky response, i.e., the response is time-variant such that the response tends over time to a flat frequency response or another predetermined initial frequency response, so that any erroneous adaptation is corrected by undoing the adaptation over time. In ANC circuit 30B, frequency characteristic determination logic 54 controls a level of leakage with a control signal leakage, which may have only two states, i.e. leakage enabled or disabled, or may have a value that controls a time constant or update rate of the leakage applied to restore $W_{ADAPT}(z)$ to an initial response.

Figure 3C:
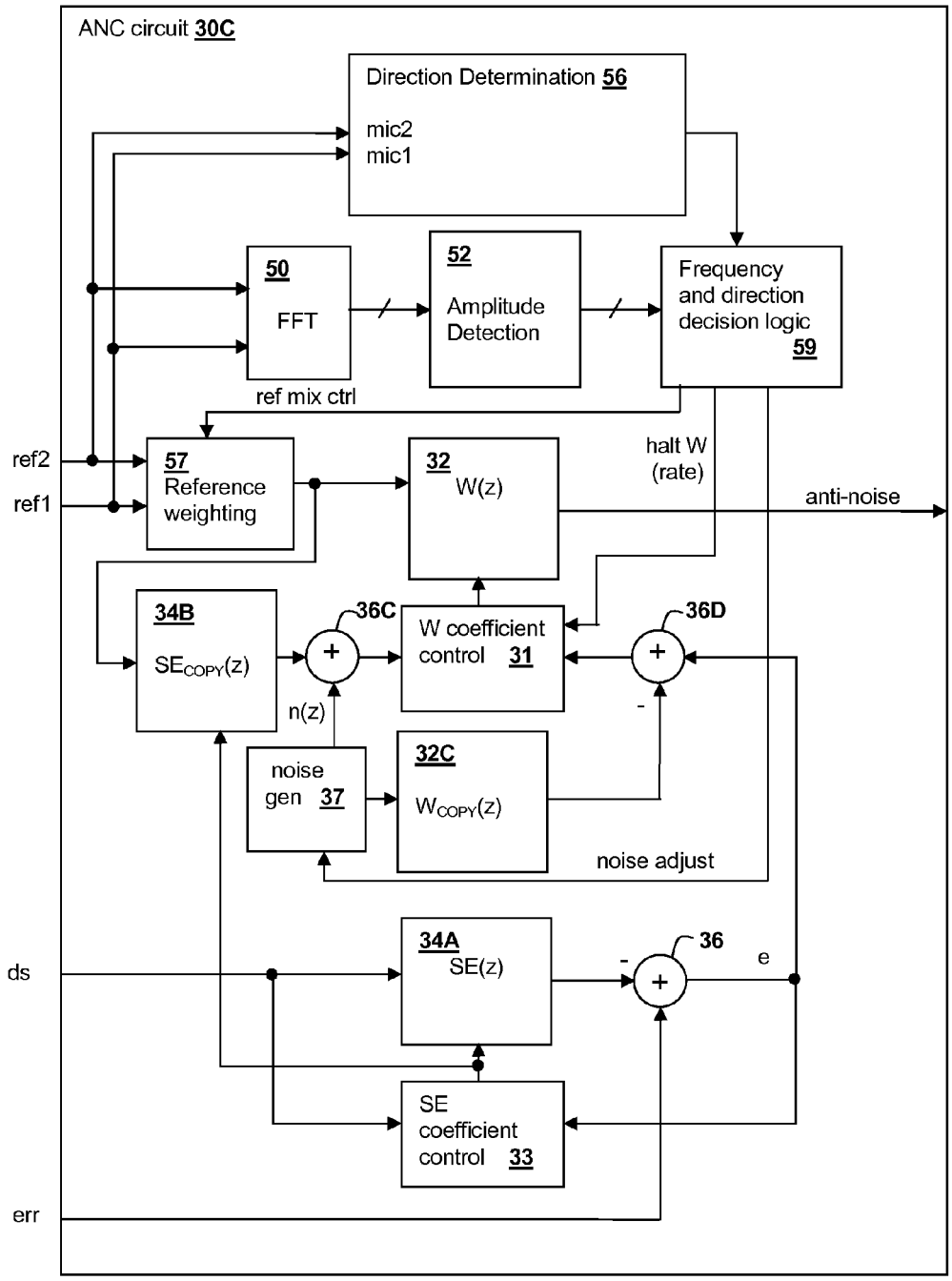

Referring now to FIG. 3C, details of another ANC circuit 30C are shown in accordance with another exemplary circuit that may be used to implement ANC circuit 30 of FIG. 2. ANC circuit 30C is similar to ANC circuit 30A of FIG. 3A, so only differences between them will be described below. ANC circuit 30C includes the frequency characteristic determining elements as in ANC circuit 30A of FIG. 3A and ANC circuit 30B of FIG. 3B, i.e., FFT block 50 and amplitude detection 52, but also includes a direction determination block 56 that estimates the direction from which the ambient sounds are arriving. A combined frequency and direction decision logic 59 generates control outputs that take action on the adaptation of response W(z) of adaptive filter 32, which may be control signal halt W or rate as illustrated that halts or changes the rate of update of the coefficients generated by W coefficient control block 31. Other outputs may additionally or alternatively control adaptation of response W(z) of adaptive filter 32 as in ANC circuit 30A of FIG. 3A and ANC circuit 30B, e.g., selecting response $C_e(z)$ of filter 37B and response $C_x(z)$ of filter 37A as in ANC circuit 30A, or adjusting leakage of response W(z) as in ANC circuit 30B. In order to measure the direction of the incoming ambient sounds, two microphones are needed, which may be provided by reference microphone R in combination with another microphone such as near-speech microphone NS or error microphone E. However, to avoid the problem of distinguishing actual near speech from ambient sounds, and the different response of error microphone E to the ambient environment when the personal audio device 10 is against the user's ear, it is useful to provide two reference microphones for generating two reference microphone signals ref1 and ref2 as illustrated as inputs to ANC circuit 30C in FIG. 3C. A reference weighting block 57 is controlled by a control signal ref mix ctrl provided by frequency and direction decision logic 59, which can improve performance of ANC circuit 30C by selecting between reference microphone signals ref1 and ref2 or combining them with different gains, to provide the best measure of the ambient sounds.

Additionally, FIG. 3C illustrates yet another technique for altering the adaptation of the response W(z) of adaptive filter 32, which may optionally be included within either ANC circuit 30A of FIG. 3A and ANC circuit 30B of FIG. 3B. Rather than adjusting leakage of response W(z) or adjusting the response of the inputs to W coefficient control block 31, ANC circuit 30C injects a noise signal n(z) using a noise generator 37 that is supplied to a copy $W_{COPY}(z)$ of the response W(z) of adaptive filter 32 provided by an adaptive filter 32C. A combiner 36C adds noise signal noise(z) to the output of adaptive filter 34B that is provided to W coefficient control 31. Noise signal n(z), as shaped by filter 32C, is subtracted from the output of combiner 36 by a combiner 36D so that noise signal n(z) is asymmetrically added to the correlation inputs to W coefficient control 31, with the result that the response W(z) of adaptive filter 32 is biased by the completely correlated injection of noise signal n(z) to each correlation input to W coefficient control 31. Since the injected noise appears directly at the reference input to W coefficient control 31, does not appear in error microphone signal err, and only appears at the other input to W coefficient control 31 via the combining of the filtered noise at the output of filter 32C by combiner 36D, W coefficient control 31 will adapt response W(z) to attenuate the frequencies present in noise signal n(z). The content of noise signal n(z) does not appear in the anti-noise signal, but only appears in the response W(z) of adaptive filter 32 which will have amplitude decreases at the frequencies/bands in which noise signal n(z) has energy. Depending on the frequency content of, or direction of, the ambient sounds arriving at personal audio device 10, frequency and direction decision logic block 59 can alter control signal noise adjust to select the spectrum that is injected by noise generator 37.

Figure 4:
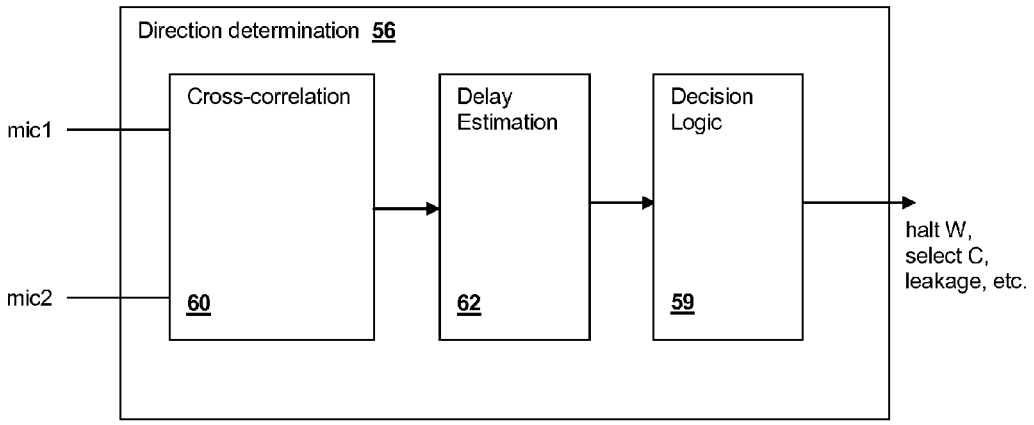
FIG. 4 is a block diagram depicting a direction detection circuit that can be implemented within CODEC integrated circuit 20.

Referring now to FIG. 4, details of an exemplary direction determination block 56 of ANC circuit 30C are shown. Direction determination block 56 may also be used, alternatively with or in combination with, the frequency characteristic determining circuits in ANC circuit 30A or ANC circuit 30B. Direction determining block 56 determines information about direction of the ambient sounds by using two microphones, which may be a pair of reference microphones, or a combination of any two or more of reference microphone R, error microphone E and near-speech microphone NS. A cross-correlation is performed on the microphone signals, e.g., exemplary microphone signals mic1 and mic2, which may be outputs of any combination of the above microphones. The cross-correlation is used to compute a delay confidence factor, which is a waveform indicative of the delay between ambient sounds present in both microphone signals mic1 and mic2. The delay confidence factor is defined as $(T)^*\rho_{mic1*mic2}(T)$, where $\rho_{mic1*mic2}(T)$ is the cross-correlation of microphone signals mic1 and mic2 and $T=\arg\max_T[\rho_{mic1*mic2}(T)]$, which is the time at which the value of cross-correlation $\rho_{mic1*mic2(T)}$ of microphone signals mic1 and mic2 is at a maximum. A delay estimation circuit 62 estimates the actual delay from the result of the cross-correlation function and decision logic block 59 determines whether or not to take action on the adaptation of the ANC circuits, depending on the direction of the detected ambient sounds. Decision logic block 59 may additionally receive inputs from frequency characteristic determination logic 54 of FIG. 3B so that a combination of frequency-dependent characteristics and directional information can be used to determine whether to take action such as halting W(z) adaptation, increasing leakage in the example of FIG. 3B, or selecting alternate responses for response $C_e(z)$ of filter 37B and response $C_x(z)$ of filter 37A, in the example of FIG. 3A.

Figure 5:
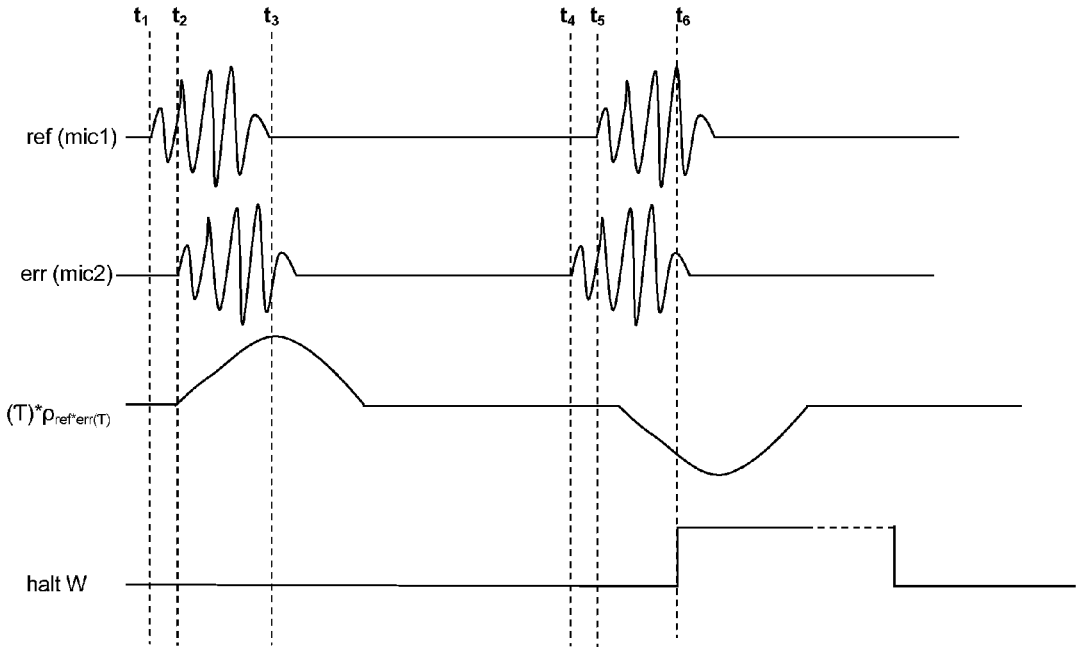
FIG. 5 is a signal waveform diagram illustrating operation of direction determining block 56.

Referring now to FIG. 5, a signal waveform diagram of signals within the circuit depicted in FIG. 4 is shown. At time $t_1$, an ambient sound has arrived at reference microphone R, and appears in reference microphone signal ref, which is an example of first microphone signal mic1. At time $t_2$, the same ambient sound has arrived at error microphone E, and appears in error microphone signal err, which is an example of second microphone signal mic2. The delay confidence factor $(T)^*\rho_{ref*err(T)}$ of the error microphone signal err and reference microphone signal ref is illustrated. The peak value of the delay confidence factor $(T)^*\rho_{ref*err(T)}$ at time $t_3$ is indicative of the delay between the arrival times at reference microphone R and error microphone E. Thus, for the first ambient sound arriving in the diagram of FIG. 5, the direction is toward the reference microphone, and therefore it could be expected that the ANC circuits could effectively cancel the ambient sound, barring any contrary indication from frequency characteristic determination logic 54 or another source of problem detection. However, the second ambient sound shown in FIG. 5 arrives at error microphone E at time $t_4$ and then at the reference microphone at time $t_5$, which indicates that the ambient sound is coming from the direction of error microphone E and possibly cannot be effectively canceled by the ANC system, in particular if the frequency content of the ambient sound is near the upper limit of ANC effectiveness. The direction is indicated in the reversed polarity of delay confidence factor $(T)^*\rho_{ref*err}(T)$. Therefore, at time $t_6$, when sufficient confidence that the ambient sound is coming from the direction of the transducer and error microphone E, rather than reference microphone R, decision logic 64 asserts control signal halt W to cease updating the coefficients of response W(z). Alternatively other actions such as increasing leakage or selecting different responses for $C_e(z)$ of filter 37B and response $C_x(z)$ of filter 37A could be performed in response to detecting such a condition. The examples illustrated in FIG. 4 and FIG. 5 are only illustrative, and in general, observation about repetitive or longer ambient sounds may be performed to effectively identify the direction of ambient sounds that may be problematic and require intervention in the ANC system. In particular, since processing and electro-acoustical path delays impact the ability of the ANC circuits to react to and cancel incoming ambient sounds, it is generally necessary to apply a criteria that if an ambient sound arrives at the reference microphone less than a predetermined period of time before arrival of the ambient sound at the error microphone, then the ANC circuit may determine not to alter ANC behavior in response to that condition.

Figure 6:
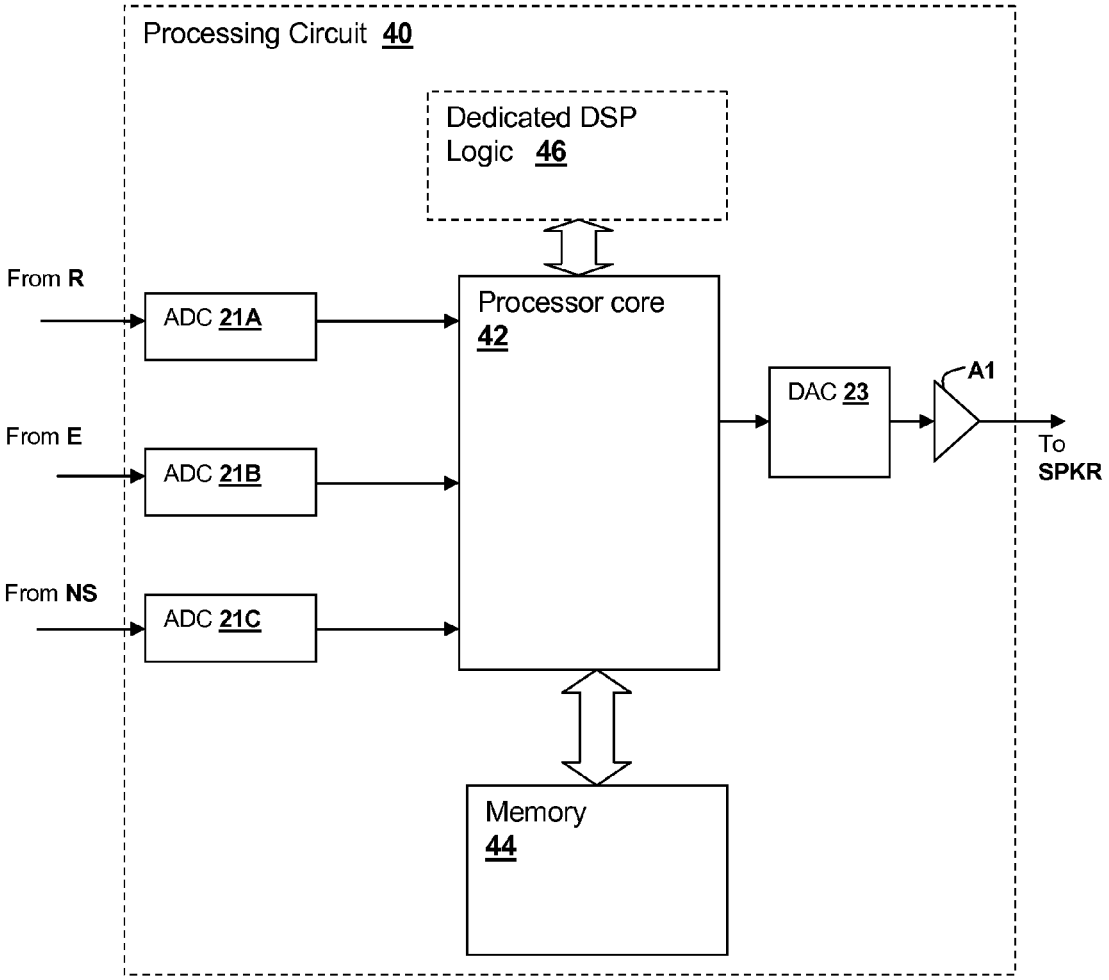
FIG. 6 is a block diagram depicting signal processing circuits and functional blocks within CODEC integrated circuit 20.

Referring now to FIG. 6, a block diagram of an ANC system is shown for implementing ANC techniques as depicted in FIG. 3, and having a processing circuit 40 as may be implemented within CODEC integrated circuit 20 of FIG. 2. Processing circuit 40 includes a processor core 42 coupled to a memory 44 in which are stored program instructions comprising a computer-program product that may implement some or all of the above-described ANC techniques, as well as other signal processing. Optionally, a dedicated digital signal processing (DSP) logic 46 may be provided to implement a portion of, or alternatively all of, the ANC signal processing provided by processing circuit 40. Processing circuit 40 also includes ADCs 21A-21C, for receiving inputs from reference microphone R, error microphone E and near speech microphone NS, respectively. DAC 23 and amplifier A1 are also provided by processing circuit 40 for providing the transducer output signal, including anti-noise as described above.

While the invention has been particularly shown and described with reference to the preferred embodiments thereof, it will be understood by those skilled in the art that the foregoing and other changes in form, and details may be made therein without departing from the spirit and scope of the invention.

What is claimed is:

1. A personal audio device, comprising:

a personal audio device housing;

a transducer mounted on the housing for reproducing an audio signal including both source audio for playback to a listener and an anti-noise signal for countering the effects of ambient audio sounds in an acoustic output of the transducer;

a reference microphone mounted on the housing for a reference microphone signal indicative of the ambient audio sounds;

an error microphone mounted on the housing in proximity to the transducer for providing an error microphone signal indicative of the acoustic output of the transducer and the ambient audio sounds at the transducer; and a processing circuit that generates the anti-noise signal from the reference microphone signal to reduce the presence of the ambient audio sounds heard by the listener using an adaptive filter having a response controlled by a coefficient control block having a first input receiving a first signal derived from the reference microphone signal and a second input receiving a second signal derived from the error microphone signal, wherein the processing circuit analyzes the reference microphone signal to detect ambient sounds and determine one or more frequencies or frequency bands in which the ambient sounds have energy, and wherein the processing circuit alters adaptation of the response of the adaptive filter in response to the detection of the ambient sounds and in conformity with a result of determining the one or more frequencies or frequency bands by altering frequency content of either the first signal or the second signal to reduce a sensitivity of the adaptation of the response of the adaptive filter at the one or more frequencies or frequency bands.

2. The personal audio device of claim 1, wherein the processing circuit further implements a secondary path filter having a secondary path response that shapes the source audio and a combiner that removes the source audio from the error microphone signal to provide an error signal indicative of the combined anti-noise and ambient audio sounds delivered to the listener, and wherein the second input of the coefficient control block receives the error signal as the second signal, whereby the response of the adaptive filter is controlled in conformity with the error signal and the reference microphone signal.

3. The personal audio device of claim 2, wherein the processing circuit filters at least one of the first or second signals with a non-adaptive filter having a fixed response selected in conformity with the one or more frequencies or frequency bands, so that sensitivity of the adaptation of the response of the adaptive filter is reduced at the one or more frequencies or frequency bands by the fixed response.

4. The personal audio device of claim 3, wherein the processing circuit selects the fixed response from among multiple predetermined frequency responses.

5. The personal audio device of claim 1, wherein the processing circuit detects the ambient sounds in both of the reference microphone signal and the error microphone signal.

6. The personal audio device of claim 5, wherein the processing circuit determines a direction of the ambient sounds, and wherein the processing circuit alters the adaptation of the response of the adaptive filter selectively in conformity with the direction of the ambient sounds.

7. The personal audio device of claim 1, further comprising a near-speech microphone mounted on the housing for providing a near-speech microphone signal indicative of speech of the listener and the ambient sounds, wherein the processing circuit further detects the ambient sounds in the near-speech microphone signal.

8. The personal audio device of claim 1, wherein the processing circuit detects the ambient sounds by measuring an amplitude of the reference microphone signal in the one or more frequencies or frequency bands.

9. The personal audio device of claim 8, wherein the one or more frequencies or frequency bands are selectable.

10. The personal audio device of claim 8, further comprising:

a headset connector for connecting an external headset; and a headset type detection circuit for detecting a type of the external headset, and wherein the processing circuit further determines the one or more frequencies or frequency bands in conformity with the detected type of the external headset.

11. The personal audio device of claim 1, wherein the detecting detects whether low-frequency content is present.

12. The personal audio device of claim 1, wherein the detecting detects whether high-frequency content is present.

13. The personal audio device of claim 1, wherein the altering alters a rate of update of a coefficient control block of the adaptive filter.

14. The personal audio device of claim 1, wherein the processing circuit controls a variable portion of a frequency response of the adaptive filter with a leakage characteristic that restores the response of the adaptive filter to a predetermined response at a particular rate of change, and wherein the processing circuit alters the particular rate of change in conformity with a result of the detection of the ambient sounds.

15. The personal audio device of claim 1, wherein the processing circuit alters the frequency content of either the first signal or the second signal by injecting a signal having frequency content that reduces the sensitivity of the response of the adaptive filter at the one or more frequencies or frequency bands.

16. A method of countering effects of ambient audio sounds by a personal audio device, the method comprising:

measuring the ambient audio sounds with a reference microphone to generate a reference microphone signal;

measuring an acoustic output of a transducer and the ambient audio sounds with an error microphone to generate an error microphone signal;

adaptively generating an anti-noise signal from the reference microphone signal to reduce the presence of the ambient audio sounds heard by the listener using an adaptive filter having a response controlled by coefficients computed by a coefficient control block having a first input receiving a first signal derived from the reference microphone signal and a second input receiving a second signal derived from the error microphone signal;

combining the anti-noise signal with source audio;

providing a result of the combining to the transducer;

analyzing the reference microphone signal to detect ambient sounds and determine one or more frequencies or frequency bands in which the ambient sounds have energy; and altering adaptation of the response of the adaptive filter in response to the detection of the ambient sounds and in conformity with a result of determining the one or more frequencies or frequency bands by altering frequency content of either the first signal or the second signal to reduce a sensitivity of adaptation of the response of the adaptive filter to the detected ambient sounds.

17. The method of claim 16, wherein the adaptively generating further generates the anti-noise signal from an error signal indicative of the acoustic output of the transducer and the ambient sounds, wherein the method further comprises:

shaping the source audio with a secondary path response provided by a secondary path adaptive filter; and removing the shaped source audio from the error microphone signal to generate the error signal.

18. The method of claim 17, wherein the altering frequency content comprises filtering the first signal or the second signal with a non-adaptive filter having a fixed response selected in conformity with the one or more frequencies or frequency bands, so that sensitivity of the adaptation of the response of the adaptive filter is reduced at the one or more frequencies or frequency bands by the fixed response.

19. The method of claim 18, further comprising selecting the fixed response from among multiple predetermined frequency responses.

20. The method of claim 16, wherein the detecting detects the ambient sounds in both of the reference microphone signal and the error microphone signal.

21. The method of claim 20, wherein the method further comprises determining a direction of the ambient sounds, and wherein the altering alters the adaptation of the response of the adaptive filter selectively in conformity with the determined direction of the ambient sounds.

22. The method of claim 16, wherein the personal audio device includes a near-speech microphone mounted on a housing of the personal audio device for providing a near-speech microphone signal indicative of speech of the listener and the ambient sounds, and wherein the detecting further detects the ambient sounds in the near-speech microphone signal.

23. The method of claim 16, wherein the detecting detects the ambient sounds by measuring an amplitude of the reference microphone signal in the one or more frequencies or frequency bands.

24. The method of claim 23, further comprising selecting the one or more frequencies or frequency bands from among multiple predetermined frequencies or frequency bands.

25. The method of claim 23, further comprising:

connecting an external headset to the personal audio device; and detecting a type of the external headset, and wherein the determining further determines the one or more frequencies or frequency bands in conformity with the detected type of the external headset.

26. The method of claim 16, wherein the detecting detects whether low-frequency content is present.

27. The method of claim 16, wherein the detecting detects whether high-frequency content is present.

28. The method of claim 16, wherein the altering alters a rate of update of a coefficient control block of the adaptive filter.

29. The method of claim 16, further comprising:

controlling a variable portion of a frequency response of the adaptive filter with a leakage characteristic that restores the response of the adaptive filter to a predetermined response at a particular rate of change; and altering the particular rate of change in conformity with a result of the detection of the ambient sounds.

30. The method of claim 16, wherein the altering alters the frequency content of the first signal or the second signal by injecting a signal having frequency content that reduces the sensitivity of the response of the adaptive filter at the one or more frequencies or frequency bands.

31. An integrated circuit for implementing at least a portion of a personal audio device, comprising:

an output for providing an output signal to an output transducer including both source audio for playback to a listener and an anti-noise signal for countering the effects of ambient audio sounds in an acoustic output of the transducer;

reference microphone input for receiving a reference microphone signal indicative of the ambient audio sounds;

an error microphone input for receiving an error microphone signal indicative of the acoustic output of the transducer and the ambient audio sounds at the transducer; and a processing circuit that generates the anti-noise signal from the reference microphone signal to reduce the presence of the ambient audio sounds heard by the listener using an adaptive filter having a response controlled by a coefficient control block having a first input receiving a first signal derived from the reference microphone signal and a second input receiving a second signal derived from the error microphone signal, wherein the processing circuit analyzes the reference microphone signal to detect ambient sounds and determine one or more frequencies or frequency bands in which the ambient sounds have energy, and wherein the processing circuit alters adaptation of the response of the adaptive filter in response to the detection of the ambient sounds and in conformity with a result of determining the one or more frequencies or frequency bands by altering frequency content of either the first signal or the second signal to reduce a sensitivity of the adaptation of the response of the adaptive filter at the one or more frequencies or frequency bands.

32. The integrated circuit of claim 31, wherein the processing circuit further implements a secondary path filter having a secondary path response that shapes the source audio and a combiner that removes the source audio from the error microphone signal to provide an error signal indicative of the combined anti-noise and ambient audio sounds delivered to the listener, and wherein the second input of the coefficient control block receives the error signal as the second signal, whereby the response of the adaptive filter is controlled in conformity with the error signal and the reference microphone signal.

33. The integrated circuit of claim 32 wherein the processing circuit filters at least one of the first or second signals with a non-adaptive filter having a fixed response selected in conformity with the one or more frequencies or frequency bands, so that sensitivity of the adaptation of the response of the adaptive filter is reduced at the one or more frequencies or frequency bands by the fixed response.

34. The integrated circuit of claim 33, wherein the processing circuit selects the fixed response from among multiple predetermined frequency responses.

35. The integrated circuit of claim 31, wherein the processing circuit detects the ambient sounds in both of the reference microphone signal and the error microphone signal.

36. The integrated circuit of claim 35, wherein the processing circuit determines a direction of the ambient sounds, and wherein the processing circuit alters the adaptation of the adaptive filter selectively in conformity with the direction of the ambient sounds.

37. The integrated circuit of claim 31, further comprising a near speech microphone input for receiving a near-speech microphone signal indicative of speech of the listener and the ambient sounds, wherein the processing circuit detects the ambient sounds in the near-speech microphone signal.

38. The integrated circuit of claim 31, wherein the processing circuit detects the ambient sounds by measuring an amplitude of the reference microphone signal in the one or more frequencies or frequency bands.

39. The integrated circuit of claim 38, wherein the one or more frequencies or frequency bands are selectable.

40. The integrated circuit of claim 38, further comprising a headset type detection circuit for detecting a type of an external headset coupled to the output, and wherein the processing circuit further determines the one or more frequencies or frequency bands in conformity with the detected type of the external headset.

41. The integrated circuit of claim 31, wherein the detecting detects whether low-frequency content is present.

42. The integrated circuit of claim 31, wherein the detecting detects whether high-frequency content is present.

43. The integrated circuit of claim 31, wherein the altering alters a rate of update of a coefficient control block of the adaptive filter.

44. The integrated circuit of claim 31, wherein the processing circuit controls a variable portion of a frequency response of the adaptive filter with a leakage characteristic that restores the response of the adaptive filter to a predetermined response at a particular rate of change, and wherein the processing circuit alters the particular rate of change in conformity with a result of the detection of the ambient sounds.

45. The integrated circuit of claim 31, wherein the processing circuit alters the frequency content of either the first signal or the second signal by injecting a signal having frequency content that reduces the sensitivity of the response of the adaptive filter at the one or more frequencies or frequency bands.

* * * * *